US009496614B2

(12) United States Patent
Bringuier et al.

(10) Patent No.: US 9,496,614 B2
(45) Date of Patent: Nov. 15, 2016

(54) ANTENNA SYSTEM USING CAPACITIVELY COUPLED COMPOUND LOOP ANTENNAS WITH ANTENNA ISOLATION PROVISION

(71) Applicant: DOCKON AG, Zürich (CH)

(72) Inventors: Jonathan Neil Bringuier, Carlsbad, CA (US); Ryan James Orsi, San Diego, CA (US); Matthew Robert Foster, San Diego, CA (US)

(73) Assignee: DOCKON AG, Zurich (CH)

( * ) Notice: Subject to any disclaimer, the term of this patent is extended or adjusted under 35 U.S.C. 154(b) by 266 days.

(21) Appl. No.: 14/253,678

(22) Filed: Apr. 15, 2014

(65) Prior Publication Data

US 2015/0295311 A1 Oct. 15, 2015

(51) Int. Cl.

| | |
|---|---|
| ***H01Q 1/00*** | (2006.01) |
| ***H01Q 5/307*** | (2015.01) |
| ***H01Q 9/04*** | (2006.01) |
| ***H01Q 7/00*** | (2006.01) |
| ***H01Q 21/30*** | (2006.01) |

(52) U.S. Cl.
CPC ..... *H01Q 5/307* (2015.01); *H01Q 7/00* (2013.01); *H01Q 9/0407* (2013.01); *H01Q 21/30* (2013.01)

(58) Field of Classification Search
USPC ..... 343/729, 700 MS, 702
See application file for complete search history.

(56) References Cited

U.S. PATENT DOCUMENTS

| | | | | |
|---|---|---|---|---|
| 5,952,982 | A | 9/1999 | Jorgenson et al. | |
| 6,307,509 | B1 | 10/2001 | Krantz | |
| 7,289,068 | B2 * | 10/2007 | Fujio | H01Q 9/0407 343/700 MS |
| 8,009,119 | B2 * | 8/2011 | Hung | H01Q 1/38 343/702 |
| 8,144,065 | B2 | 3/2012 | Brown | |
| 8,149,173 | B2 | 4/2012 | Brown | |
| 8,164,532 | B1 | 4/2012 | Brown et al. | |
| 8,350,770 | B1 | 1/2013 | Dawson | |
| 2005/0243005 | A1 | 11/2005 | Rafi et al. | |
| 2010/0060528 | A1 * | 3/2010 | Chiu | H01Q 1/243 343/700 MS |

(Continued)

FOREIGN PATENT DOCUMENTS

| | | | |
|---|---|---|---|
| EP | 1753080 | A1 | 2/2007 |
| WO | WO 2009/118565 | A1 | 10/2009 |

OTHER PUBLICATIONS

International Patent Application No. PCT/US2014/69627; Int'l Preliminary Report on Patentability; dated Dec. 11, 2015; 19 pages.

(Continued)

*Primary Examiner* — Hoang V Nguyen
*Assistant Examiner* — Hai Tran
(74) *Attorney, Agent, or Firm* — Baker & Hostetler LLP

(57) ABSTRACT

An antenna system is provided, including a first antenna, a second antenna, a ground plane, and a resonant isolator coupled to the first and second antennas. Each of the antennas is configured to be a capacitively-coupled compound loop antenna, and the resonant isolator is configured to provide isolation between the two antennas at resonance. The two antennas may be symmetrical or asymmetrical and include a first element that emits a magnetic field and a second element that generates an electrical field that is orthogonal to the magnetic field. The radiating element of the second element may be capacitively coupled to the remainder of the second element. The resonate isolator may be comprised of a single conductive element or two conductive elements that are capacitively coupled.

22 Claims, 15 Drawing Sheets

(56) References Cited

U.S. PATENT DOCUMENTS

| | | | | |
|---|---|---|---|---|
| 2010/0156745 | A1* | 6/2010 | Andrenko | H01Q 1/38 343/848 |
| 2010/0171563 | A1 | 7/2010 | Dupuy et al. | |
| 2011/0018776 | A1 | 1/2011 | Brown | |
| 2013/0113666 | A1 | 5/2013 | Orsi et al. | |
| 2013/0335280 | A1 | 12/2013 | Chen et al. | |

OTHER PUBLICATIONS

International Patent Application No. PCT/US2015/21113; Int'l Search Report and the Written Opinion; dated Jul. 1, 2015; 14 pages.

* cited by examiner

Y-Z Plane

X-Y Plane

X-Z Plane

Y-Z Plane

X-Z Plane

X-Y Plane

Y-Z Plane

X-Z Plane

X-Y Plane

ANTENNA SYSTEM USING CAPACITIVELY COUPLED COMPOUND LOOP ANTENNAS WITH ANTENNA ISOLATION PROVISION

TECHNICAL FIELD

The present disclosure relates to compound loop antenna.

BACKGROUND

As new generations of cellular phones and other wireless communication devices become smaller and embedded with increased applications, new antenna designs are required to address inherent limitations of these devices and to enable new capabilities. With conventional antenna structures, a certain physical volume is required to produce a resonant antenna structure at a particular frequency and with a particular bandwidth. However, effective implementation of such antennas is often confronted with size constraints due to a limited available space in the device.

Antenna efficiency is one of the important parameters that determine the performance of the device. In particular, radiation efficiency is a metric describing how effectively the radiation occurs, and is expressed as the ratio of the radiated power to the input power of the antenna. A more efficient antenna will radiate a higher proportion of the energy fed to it. Likewise, due to the inherent reciprocity of antennas, a more efficient antenna will convert more of a received energy into electrical energy. Therefore, antennas having both good efficiency and compact size are often desired for a wide variety of applications.

Conventional loop antennas are typically current fed devices, which generate primarily a magnetic (H) field. As such, they are not typically suitable as transmitters. This is especially true of small loop antennas (i.e. those smaller than, or having a diameter less than, one wavelength). The amount of radiation energy received by a loop antenna is, in part, determined by its area. Typically, each time the area of the loop is halved, the amount of energy which may be received is reduced by approximately 3 dB. Thus, the size-efficiency tradeoff is one of the major considerations for loop antenna designs.

Voltage fed antennas, such as dipoles, radiate both electric (E) and H fields and can be used in both transmit and receive modes. Compound antennas are those in which both the transverse magnetic (TM) and transverse electric (TE) modes are excited, resulting in performance benefits such as wide bandwidth (lower Q), large radiation intensity/power/gain, and good efficiency. There are a number of examples of two dimensional, non-compound antennas, which generally include printed strips of metal on a circuit board. Most of these antennas are voltage fed. An example of one such antenna is the planar inverted F antenna (PIFA). A large number of antenna designs utilize quarter wavelength (or some multiple of a quarter wavelength), voltage fed, dipole antennas.

Use of MIMO (multiple input multiple output) technologies is increasing in today's wireless communication devices to provide enhanced data communication rates while minimizing error rates. A MIMO system is designed to mitigate interference from multipath environments by using several transmit (Tx) antennas at the same time to transmit different signals, which are not identical but are different variants of the same message, and several receive (Rx) antennas at the same time to receive the different signals. A MIMO system can generally offer significant increases in data throughput without additional bandwidth or increased transmit power by spreading the same total transmit power over the antennas so as to achieve an array gain. MIMO protocols constitute a part of wireless communication standards such as IEEE 802.11n (WiFi), 4G, Long Term Evolution (LTE), WiMAX and HSPA+. However, in a configuration with multiple antennas, size constraints tend to become severe, and interference effects caused by electromagnetic coupling among the antennas may significantly deteriorate transmission and reception qualities. At the same time, efficiency may deteriorate in many instances where multiple paths are energized and power consumption increases.

SUMMARY

An antenna system is provided, including a first antenna, a second antenna, a ground plane, and a resonant isolator coupled to the first and second antennas. Each of the antennas is configured to be a capacitively-coupled compound loop antenna, and the resonant isolator is configured to provide isolation between the two antennas at resonance. The two antennas may be symmetrical or asymmetrical and include a first element that emits a magnetic field and a second element that generates an electrical field that is orthogonal to the magnetic field. The radiating element of the second element may be capacitively coupled to the remainder of the second element. The resonate isolator may be comprised of a single conductive element or two conductive elements that are capacitively coupled.

BRIEF DESCRIPTION OF THE DRAWINGS

FIG. 3A illustrates the top view of a first layer including Antenna 1, Antenna 2 and a first ground plane, and FIG. 3B illustrates the bottom view of a second layer including a second ground plane.

FIG. 4A illustrates the top view of a first layer including Antenna 1, Antenna 2 and a first ground plane, and FIG. 4B illustrates the bottom view of a second layer including a second ground plane and the resonant isolator.

DETAILED DESCRIPTION OF ILLUSTRATIVE EMBODIMENTS

In view of known limitations associated with conventional antennas, in particular with regard to radiation efficiency, a compound loop antenna (CPL), also referred to as a modified loop antenna, has been devised to provide both transmit and receive modes with greater efficiency than a conventional antenna with a comparable size. Examples of structures and implementations of the CPL antennas are described in U.S. Pat. No. 8,144,065, issued on Mar. 27, 2012, U.S. Pat. No. 8,149,173, issued on Apr. 3, 2012, and U.S. Pat. No. 8,164,532, issued on Apr. 24, 2012. Key features of the CPL antennas are summarized below with reference to the example illustrated in FIG. 1.

Figure 1:
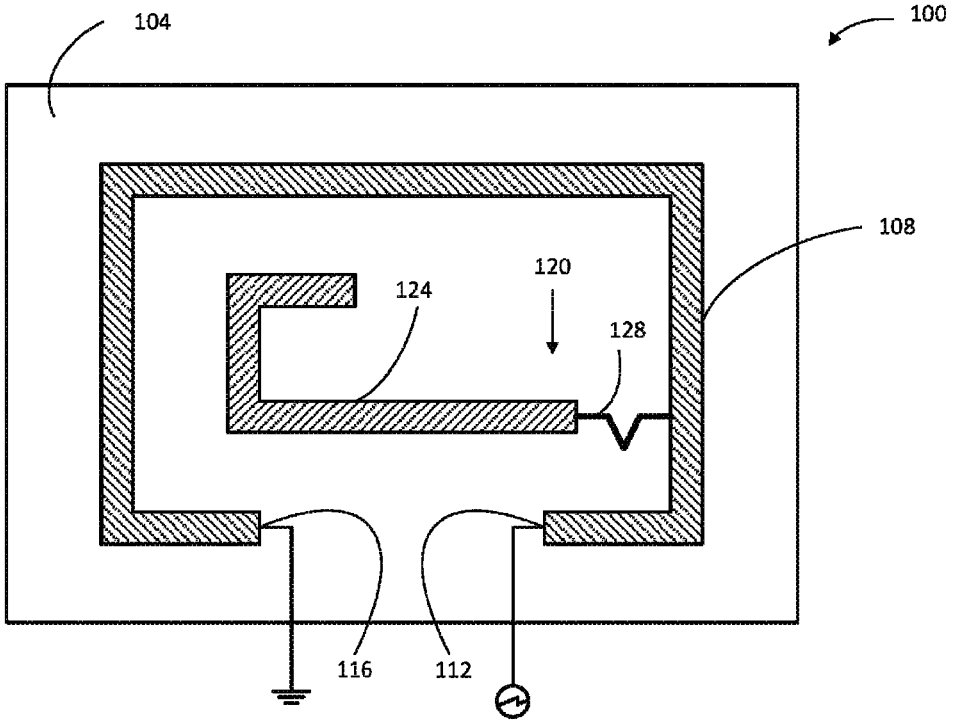
FIG. 1 illustrates an example of a planar CPL antenna.

FIG. 1 illustrates an example of a planar CPL antenna 100. In this example, the planar CPL antenna 100 is printed on a printed circuit board (PCB) 104, and includes a loop element 108, which in this case is formed as a trace along rectangle edges with an open base portion providing two end portions 112 and 116. One end portion 112 is a feed point of the antenna where the current is fed. The other end portion 116 is shorted to ground. The CPL antenna 100 further includes a radiating element 120 that has a J-shaped trace 124 and a meander trace 128. In this example, the meander trace 128 is configured to couple the J-shaped trace 124 to the loop element 108. The radiating element 120 essentially functions as a series resonant circuit providing an inductance and a capacitance in series, and their values are chosen such that the resonance occurs at the frequency of operation of the antenna. Instead of using the meander trace 128, the shape and dimensions of the J-shaped trace 124 may be adjusted to connect directly to the loop element 108 and still provide the target resonance.

Similar to a conventional loop antenna that is typically current fed, the loop element 108 of the planar CPL antenna 100 generates a magnetic (H) field. The radiating element 120, having the series resonant circuit characteristics, effectively operates as an electric (E) field radiator (which of course is an E field receiver as well due to the reciprocity inherent in antennas). The connection point of the radiating element 120 to the loop element 108 is critical in the planar CPL antenna 100 for generating/receiving the E and H fields that are substantially orthogonal to each other. This orthogonal relationship has the effect of enabling the electromagnetic waves emitted by the antenna to effectively propagate through space. In the absence of the E and H fields arranged orthogonal to each other, the waves will not propagate effectively beyond short distances. To achieve this effect, the radiating element 120 is placed at a position where the E field produced by the radiating element 120 is 90° or 270° out of phase relative to the H field produced by the loop element 108. Specifically, the radiating element 120 is placed at the substantially 90° (or 270°) electrical length along the loop element 108 from the feed point 112. Alternatively, the radiating element 120 may be connected to a location of the loop element 108 where current flowing through the loop element 108 is at a reflective minimum.

In addition to the orthogonality of the E and H fields, it is desirable that the E and H fields are comparable to each other in magnitude. These two factors, i.e., orthogonality and comparable magnitudes, may be appreciated by looking at the Poynting vector (vector power density) defined by P=E×H (Volts/m×Amperes/m=Watts/m2). The total radiated power leaving a surface surrounding the antenna is found by integrating the Poynting vector over the surface. Accordingly, the quantity E×H is a direct measure of the radiated power, and thus the radiation efficiency. First, it is noted that when the E and H are orthogonal to each other, the vector product gives the maximum. Second, since the overall magnitude of a product of two quantities is limited by the smaller, having the two quantities (|H| and |E| in this case) as close as possible will give the optimal product value. As explained above, in the planar CPL antenna, the orthogonally is achieved by placing the radiating element 120 at the substantially 90° (or 270°) electrical length along the loop element 108 from the feed point 112. Furthermore, the shapes and dimensions of the loop element 108 and the radiating element 120 can be each configured to provide comparable, high |H| and |E| in magnitude, respectively. Therefore, in marked contrast to a conventional loop antenna, the planar CPL antenna can be configured not only to provide both transmit and receive modes, but also to increase the radiation efficiency.

Size reduction can be achieved by introducing a series capacitance in the loop element and/or the radiating element of the CPL antenna. Such an antenna structure, referred to as a capacitively-coupled compound loop antenna (C2CPL), has been devised to provide both transmit and receive modes with greater efficiency and smaller size than a conventional antenna. Examples of structures and implementations of the C2CPL antennas are described in U.S. patent application Ser. No. 13/669,389, entitled "Capacitively Coupled Compound Loop Antenna," filed Nov. 5, 2012. Key features of C2CPL antennas are summarized below with reference to the example illustrated in FIG. 2.

Figure 2:
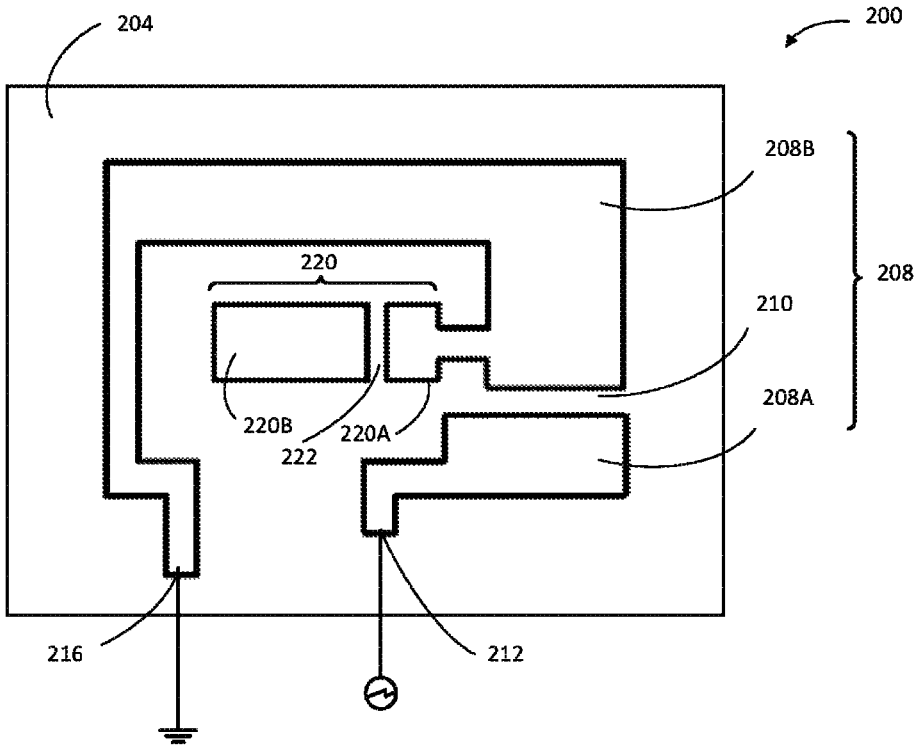
FIG. 2 illustrates an example of a planar C2CPL antenna.

FIG. 2 illustrates an example of a planar C2CPL antenna 200. In this example, the planar C2CPL antenna 200 is printed on a printed circuit board (PCB) 204, and includes a loop element 208 having a first loop section 208A and a second loop section 208B, which are capacitively coupled through a gap 210. Therefore, in the case of the C2CPL, the loop element 208 may be considered to be a first element including the two conductive sections 208A and 208B and the capacitive gap 210. The capacitance value can be adjusted by adjusting the width and the length of the gap 210. An end portion 212, which is opposite to the capacitively coupled edge of the first loop section 208A, is a current feed point of the antenna. Another end portion 216, which is opposite to the capacitively coupled edge of the second loop section 208B, is shorted to ground. The C2CPL antenna 200 further includes a radiating element 220, which is a second element, coupled to the loop element 208. Similar to the CPL antenna, the connection point of the radiating element 220 to the loop element 208 is critical in the C2CPL antenna 200 for generating/receiving the E and H fields that are substantially orthogonal to each other. To achieve this effect, the radiating element 220 is placed at the substantially 90° (or 270°) electrical length along the loop element 208 from the feed point 212. The shape and dimensions of each element of the antenna structure can be adjusted to obtain target resonances. For example, the antenna structure of FIG. 2 can be adjusted to have the 2.4/5.8 GHz dual band for certain wireless applications. In the present example illustrated in FIG. 2, the gap 210 is introduced in the loop element 208. Alternatively or additionally, a gap may be introduced in the radiating element 220 to achieve size reduction. Namely, a gap may be introduced in the first element and/or the second element, and the separate sections are configured to be capacitively coupled for the size reduction purpose. For example, radiating element 220 may comprise a first section 220A, a second section 220B and a gap 222 formed between the first section 220A and the second section 220B. In this example, the first section 220A and the second section 220B are capacitively coupled through the gap 222.

Figure 3A:
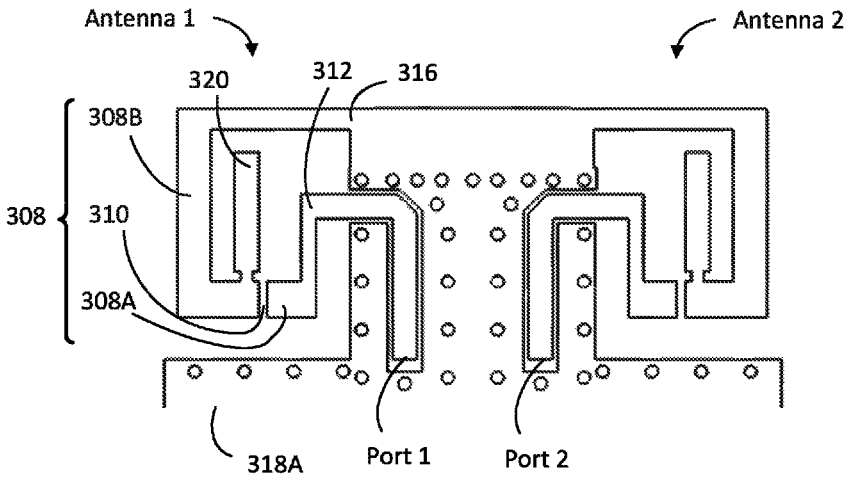
FIGS. 3A and 3B illustrate a two-antenna system having two C2CPL antennas, where
Figure 3B:
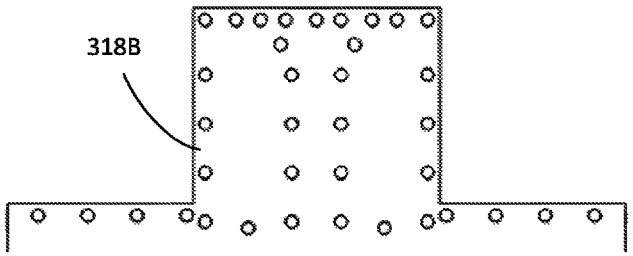

As explained above, the C2CPL antennas are capable of achieving high efficiency with reduced size; thus, these antennas are good candidates to be used for a multiple antenna system such as a MIMO system, a USB dongle, etc. FIGS. 3A and 3B illustrate a two-antenna system having two C2CPL antennas similar to the example illustrated in FIG. 2. Conductive parts of the antenna structures and ground planes may be printed on a dielectric substrate such as a PCB, ceramic, alumina, etc. Alternatively, these parts may be formed with air gaps or styrofoam in between the parts. FIG. 3A illustrates the top view of a first layer including Antenna 1, Antenna 2 and a first ground plane 318A. FIG. 3B illustrates the bottom view of a second layer including a second ground plane 318B. The first and second ground planes 318A and 318B are coupled by ground vias formed vertical to and between the first and second ground planes 318A and 318B (the ground vias are indicated with multiple small circles in the figures) so as to have an equal potential.

In this example of FIGS. 3A and 3B, Antenna 1 is a planar C2CPL antenna having a structure similar to the one illustrated in FIG. 2, and includes a loop element 308, of a first layer, having a first loop section 308A and a second loop section 308B, which are capacitively coupled through a gap 310. Therefore, the loop element 308 in the C2CPL antenna may be considered to be a first element including the two conductive sections 308A and 308B and the capacitive gap 310. A first end point 312, which is opposite to the capacitively coupled edge of the first loop section 308A, is a current feed point of Antenna 1. The feed point 312 is coupled to Port 1, which is formed in, but separated from, the first ground plane 318A, in this example, of the first layer. A second end point 316, which is opposite to the capacitively coupled edge of the second loop section 308B, is shorted to the first ground plane 318A. Antenna 1 further includes a radiating element 320, which is a second element, coupled to the loop element 308. For generating/receiving the E and H fields that are substantially orthogonal to each other, the radiating element 320 is placed at the substantially 90° (or 270°) electrical length along the loop element 308 from the feed point 312. In the present example, the gap 310 is introduced in the loop element 308. Alternatively or additionally, a gap may be introduced in the radiating element 320 to achieve size reduction. Namely, a gap may be introduced in the first element and/or the second element, and the separate sections are configured to be capacitively coupled for the size reduction purpose.

As illustrated in FIG. 3A, the second antenna, Antenna 2, is essentially a mirror image of the first antenna, Antenna 1. As illustrated, Antenna 2 is coupled to Port 2 to be current-fed independently from Antenna 1. Port 2 also is formed in, but separated from, the first ground plane 318A. In the present example, Antenna 1 and Antenna 2 are illustrated to have the same structure and to be placed symmetrically. However, differently shaped C2CPL antennas can be used, and the placement does not have to be symmetric in order to form the two-antenna system. The shape and dimensions of each element of Antenna 1 and Antenna 2 can be varied depending on target resonances. Furthermore, three or more C2CPL antennas may be used to form a multi-antenna system.

As mentioned earlier, in a configuration where multiple antennas are closely packed, interference effects caused by electromagnetic coupling among the antennas may significantly deteriorate transmission and reception qualities and efficiency. Therefore, an antenna isolation scheme is often needed for a multi-antenna system. This document describes implementations of a resonant isolator configured to couple two antennas in the system to achieve electromagnetic isolation of the antennas at resonance.

Figure 4A:
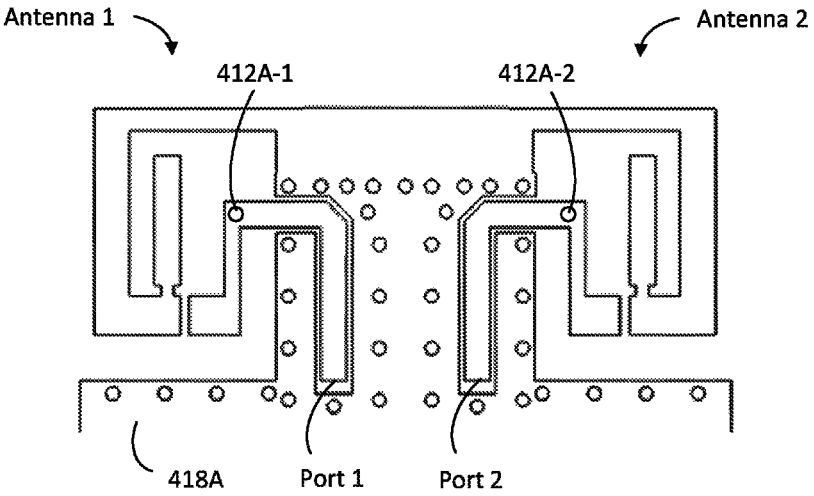
FIGS. 4A and 4B illustrate an example of a two-antenna system having two C2CPL antennas with a resonant isolator de-coupling the two antennas, where
Figure 4B:
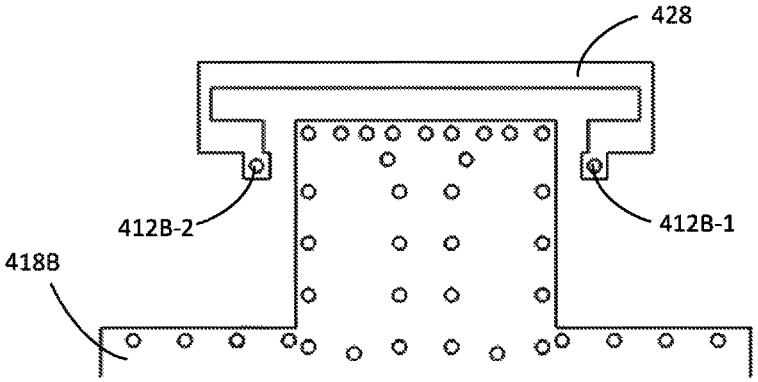

FIGS. 4A and 4B illustrate an example of the two C2CPL antenna system illustrated in FIGS. 3A and 3B where a resonant isolator is further included to de-couple the two antennas and electromagnetically isolate the two antennas at resonance. Conductive parts of the two-antenna structure and ground planes may be printed on a dielectric substrate such as a PCB, ceramic, alumina, etc. Alternatively, these parts may be formed with air gaps or styrofoam in between the parts. FIG. 4A illustrates the top view of a first layer including Antenna 1, Antenna 2 and a first ground plane 418A. FIG. 4B illustrates the bottom view of a second layer including a second ground plane 418B and a resonant isolator 428. The two ground planes are coupled with ground vias, indicated with multiple circles, to keep them at an equal potential.

In the example of FIGS. 4A and 4B, Antenna 1 is a planar C2CPL antenna having a structure similar to the one illustrated in FIG. 3A. A feed point 412A-1 is coupled to Port 1, which is formed in, but separated from, the first ground plane 418A in this example. A feed point 412A-2 of the second antenna, Antenna 2, is coupled to Port 2 to be fed independently from Antenna 1. Port 2 also is formed in, but separated from, the first ground plane. In the present example, Antenna 1 and Antenna 2 are illustrated to have the same C2CPL antenna structure and be placed symmetrically. However, different C2CPL antennas can be used, and the placement does not have to be symmetric to form the two-antenna system. The shape and dimensions of each element of Antenna 1 and Antenna 2, as well as of the resonant isolator 428, can be varied depending on target resonances.

The first and second end portions, labeled 412B-1 and 412B-2, of the resonant isolator 428 are coupled to the feed points 412A-1 and 412A-2 of Antenna 1 and Antenna 2, respectively. Vertical vias are formed in the first and second layers between points 412A-1/412B-1 and 412A-2/412B-2, with the first via coupling the first end portion 412B-1 of the resonant isolator 428 to the feed point 412A-1 of Antenna 1, and the second via coupling the second end portion 412B-2 of the resonant isolator 428 to the feed point 412A-2 of Antenna 2. The location of the resonant isolator 428 in the second layer is predetermined so as to overlap with the foot print of the first ground plane 418A formed in the first layer. In other words, the first ground plane 418A is configured to overhang the resonant isolator 428. This configuration allows for better frequency tuning than may otherwise be obtainable.

According to an embodiment, the first and second end portions, 412B-1 and 412B-2 of the resonant isolator 428 are coupled to the feed points 412A-1 and 412A-2 of Antenna 1 and Antenna 2, respectively, which is at a point where the current has a maximum value in each antenna. Furthermore, the electrical length of the resonant isolator 428 is configured to be substantially 90° or its odd multiples (270°, 450°, etc.). This configuration provides optimal isolation between the two antennas.

Furthermore, the reflected wave associated with the resonant current on the resonant isolator 428 undergoes a 180° phase shift with respect to the forward wave, since the electrical length of the resonant isolator is set to be 90°. Therefore, the forward wave and the reflected wave, which have the 180° phase offset, are combined to effectively generate an open circuit with respect to the node of the current course, which represents Antenna 1. As such, Antenna 1 and Antenna 2 can be substantially isolated at resonance due to the presence of the resonant isolator 428 that has the electrical length of 90°.

Figure 5A:
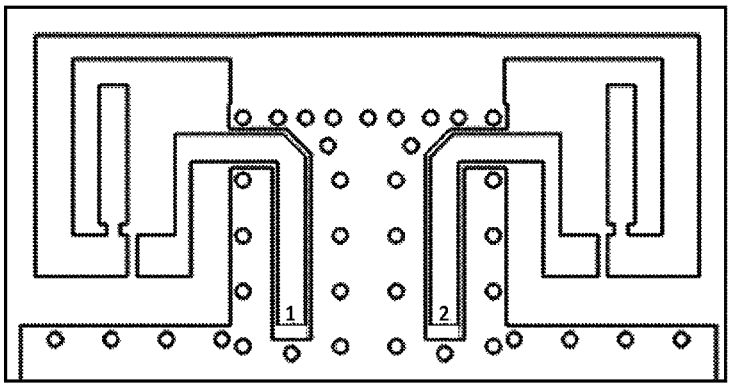
FIGS. 5A and 5B illustrate an implementation example of a device having the two-antenna system including two C2CPL antennas de-coupled by the resonant isolator, where the top view and the bottom view of the device are illustrated in FIGS. 5A and 5B, respectively.
Figure 5B:
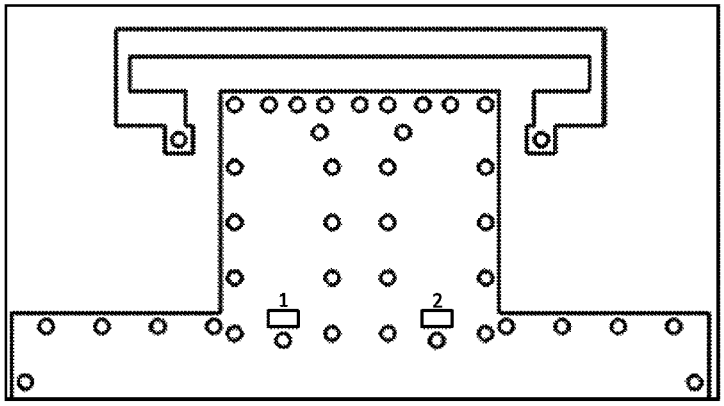

As explained in the foregoing, the two-antenna system according to an embodiment includes two C2CPL antennas de-coupled by the resonant isolator having an electrical length of substantially 90° (or its odd multiple), wherein efficiency is enhanced due to the generation of substantially orthogonal E and H fields, size reduction is achieved by configuring the capacitively coupled antenna elements, and isolation between the two antennas at resonance is enhanced due to the resonant isolator de-coupling the two antennas. FIGS. 5A and 5B illustrate an implementation example of a device having the two-antenna system including two C2CPL antennas de-coupled by the resonant isolator, as illustrated in FIGS. 4A and 4B. The top view and the bottom view of the device are illustrated in FIGS. 5A and 5B, respectively, by showing the outlines of the structure formed on the first and second layers together. The size and dimensions of each element is adjusted to obtain the 2.4 GHz band in the example provided in FIGS. 5A and 5B, but multiband implementations may be possible as well.

Figure 6:
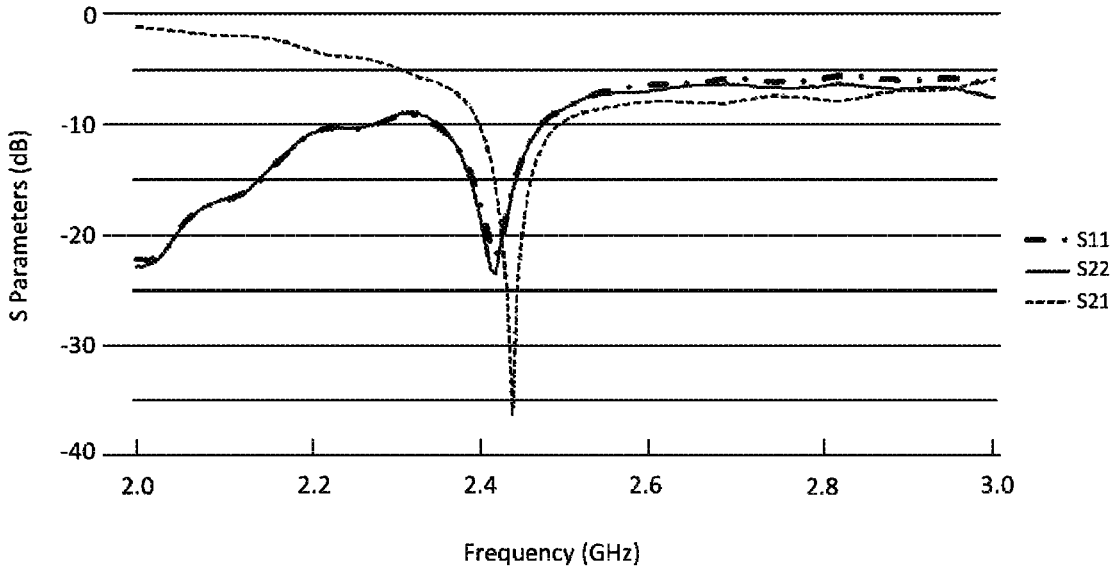
FIG. 6 is a plot illustrating measured S parameters versus frequency.

FIG. 6 is a plot illustrating measured S parameters versus frequency for the device illustrated in FIGS. 5A and 5B, where three S parameters are plotted separately. High isolation is achieved near the 2.4 GHz resonance as indicated by the S21 parameter value in this plot. It can be seen that this two-antenna system with the resonant isolator has low-pass filter characteristics exhibiting high RF transmission at low frequencies due to the strong coupling between the two antennas in this region.

Figure 7:
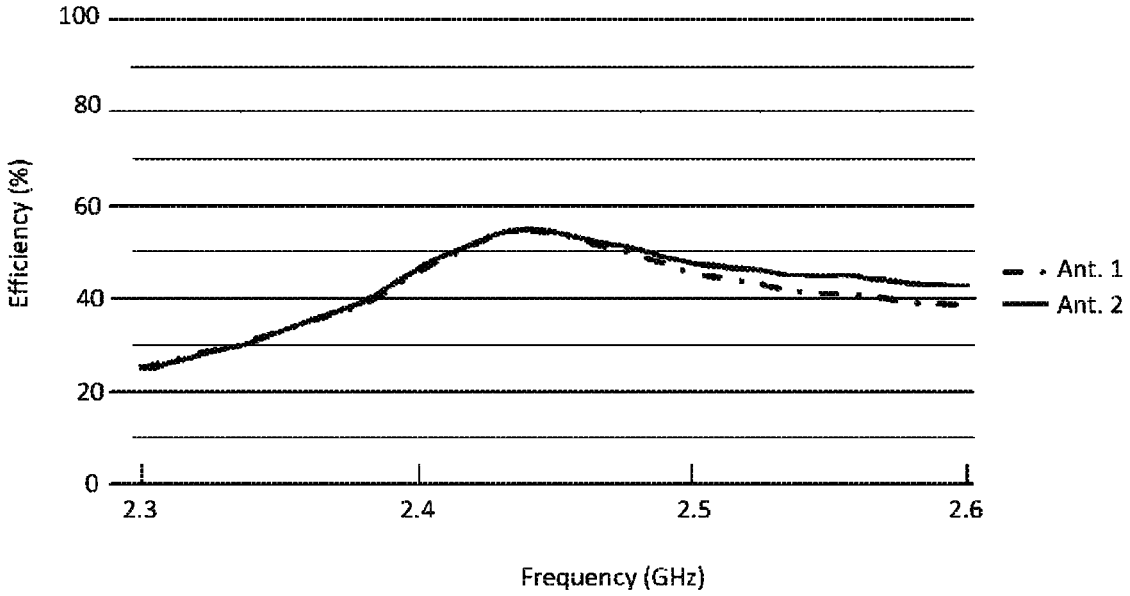
FIG. 7 is a plot illustrating measured efficiency versus frequency.

FIG. 7 is a plot illustrating measured efficiency versus frequency for the device illustrated in FIGS. 5A and 5B, where the efficiency of Antenna 1 and the efficiency of Antenna 2 are plotted separately. The efficiency value near 50% is achieved in the proximity of the 2.4 GHz resonance, in spite of the small device size afforded by the use of C2CPL antennas.

Figure 8A:
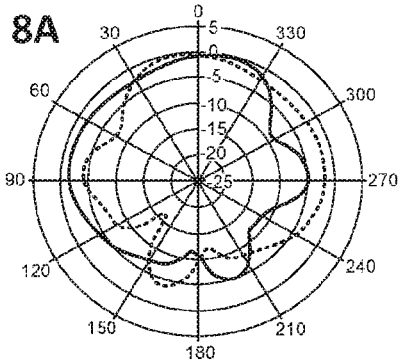
FIGS. 8A, 8B and 8C are plots illustrating measured radiation patterns at 2.45 GHz, on the Y-Z plane, the X-Y plane and the X-Z plane, respectively.
Figure 8B:
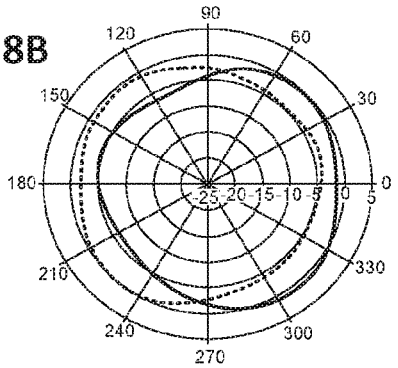
Figure 8C:
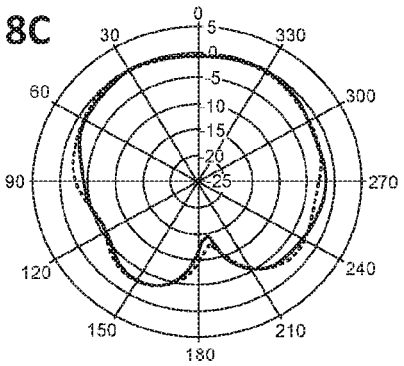
Figure 8C:
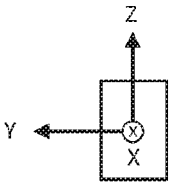

FIGS. 8A, 8B and 8C are plots illustrating measured radiation patterns at 2.45 GHz, on the Y-Z plane, the X-Y plane and the X-Z plane, respectively, for the device illustrated in FIGS. 5A and 5B, where the radiation pattern of Antenna 1 and the radiation pattern of Antenna 2 are plotted separately in each figure. The X, Y and Z axes are assigned with respect to the device placed along the Y-Z plane, as indicated in the inset. As seen from FIGS. 8A and 8B, the radiation patterns of Antenna 1 and Antenna 2 are generated complementary to each other, due to the high isolation between the two antennas. The radiation patterns on the X-Z plane in FIG. 8C show that most of the electromagnetic energy is in the upper hemisphere, with relatively small energy going downward. This is a desirable characteristic when the device is used as a USB dongle to be inserted to a PC, for example. In this configuration, the radiation patterns going downward are minimal, and thus electromagnetic interference to the electronics in the PC is minimal.

The present disclosure includes just one example of a two C2CPL antenna structure and an embodiment of a resonant isolator. However, any C2CPL antennas, such as those described in the aforementioned U.S. patent application Ser. No. 13/669,389, as well as their variations, may be used to obtain a highly efficient and isolated two-antenna system with small size. It should also be noted that it is also possible to expand the use of the resonant isolator to N antenna systems. Hence, the present disclosure is not limited to only two C2CPL antennas nor is the present disclosure limited to only CPL antennas and could likewise be used with a wide variety of other antennas. In addition, while the resonant isolator for isolating the two antennas is configured for one particular resonance in the above examples, it is possible to reconfigure the resonant isolator to provide isolation at two or more resonances for a multi-band system.

Figure 9:
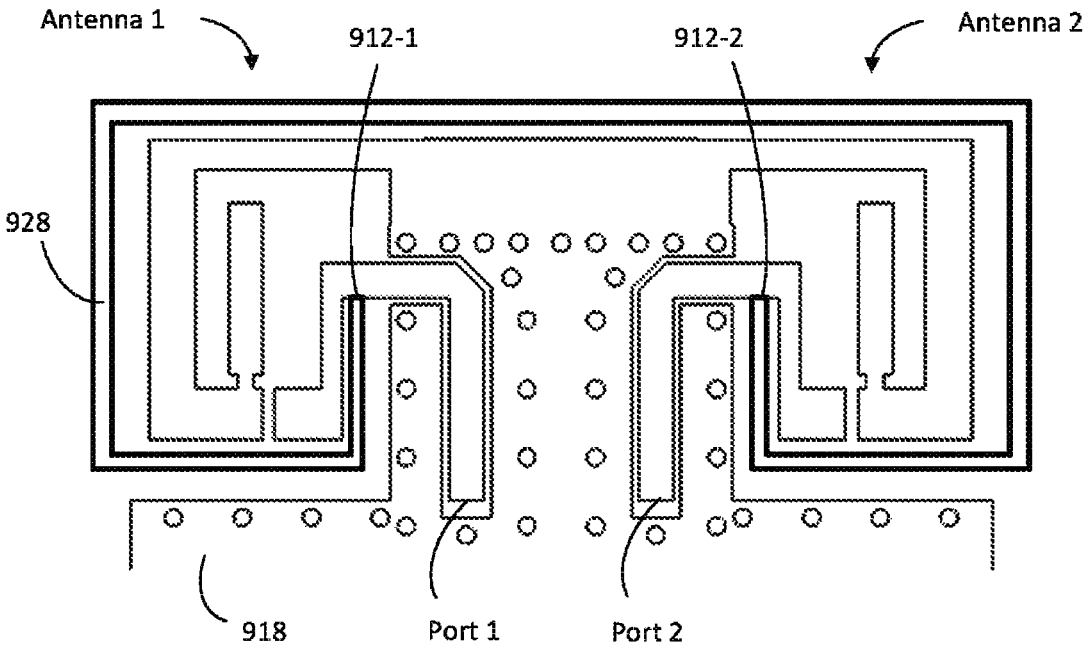
FIG. 9 illustrates another example of a two-antenna system having two C2CPL with a resonant isolator de-coupling the two antennas, where illustrated is the top view of the first layer including Antenna 1, Antenna 2, a first ground plane and the resonant isolator.

FIG. 9 illustrates another example of a two-antenna system having two C2CPL antennas similar to the example illustrated in FIG. 2, where a resonant isolator is included to de-couple the two antennas and electromagnetically isolate the two antennas at resonance. The structure of this antenna system is similar to the example illustrated in FIGS. 4A and 4B, except that the resonant isolator 928 is placed in the first layer instead of the second layer. FIG. 9 illustrates the top view of the first layer including Antenna 1, Antenna 2, a first ground plane 918 and the resonant isolator 928. A second ground plane may be formed on the second layer which is on the substrate surface opposite to the surface where the first layer is formed. The two ground planes may be coupled with ground vias to keep them at an equal potential. Alternatively, the present antenna system may be configured to have a single layer accommodating all the elements without having the second ground plane in the second layer. Each of Antenna 1 and Antenna 2 is a planar C2CPL antenna having a structure similar to the one illustrated in FIG. 2. A feed point of Antenna 1 is coupled to Port 1; and a feed point of Antenna 2 is coupled to Port 2 to be current-fed independently from Antenna 1. In the present example, Antenna 1 and Antenna 2 are illustrated to have the same C2CPL antenna structure and to be placed mirror symmetrically. However, different C2CPL antennas can be used, and the placement does not have to be mirror symmetric to form the two-antenna system. The shape and dimensions of each element of Antenna 1 and Antenna 2, as well as of the resonant isolator 1028, can be varied depending on target resonances.

The first and second end portions 912-1 and 912-2 of the resonant isolator 1028 are coupled to the locations near the feed points of Antenna 1 and Antenna 2, respectively, where the current has the maximum value in each antenna. Furthermore, the electrical length of the resonant isolator 928 is configured to be substantially 90° or its odd multiples (270°, 450°, etc.).

Figure 10A:
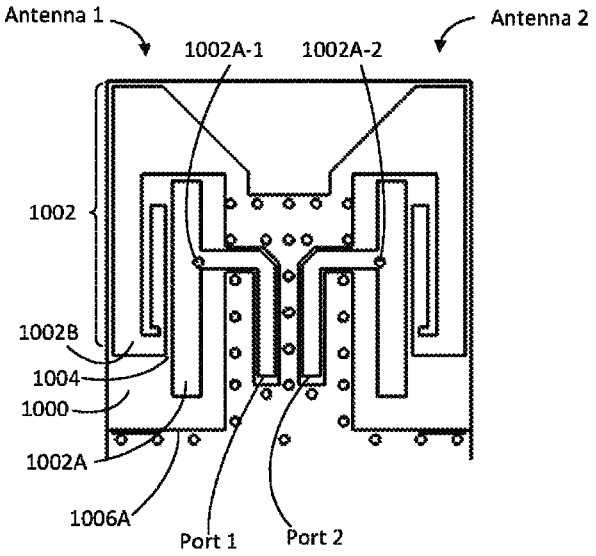
FIGS. 10A and 10B illustrate a top view and a bottom view, respectively, of an example of a two-antenna system with a capacitively coupled resonant isolator.
Figure 10B:
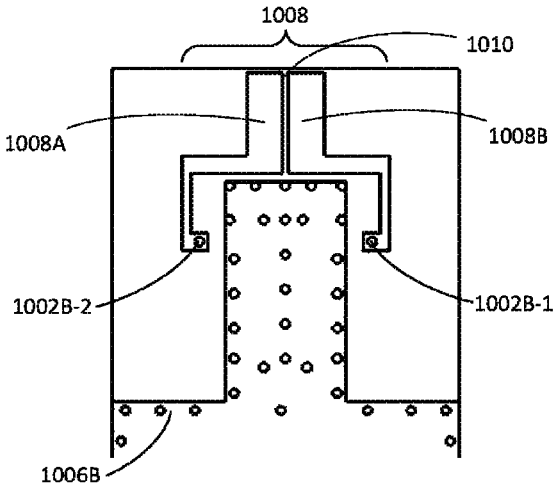

In the examples provided above, the two-antenna system operates at a single frequency and the resonant isolator is a contiguous conductive element. The example of a two-antenna system illustrated in FIGS. 10A and 10B shows a top view and a bottom view, respectively, of a multi-band, two-antenna system mounted on a dielectric substrate 1000, where the resonant isolator is formed by two separate conductive elements that are capacitively coupled. Antennas 1 and 2 are planar C2CPL antennas having a different structure from that previously illustrated. Antennas 1 and 2 include a loop element 1002 having a first loop section 1002A and a second loop section 1002B, which are capacitively coupled through a gap 1004. Therefore, the loop element 1002 in each of the C2CPL antennas may be considered to be a first element including the two conductive sections 1002A and 1002B and the capacitive gap 1004. The first loop section 1002A of Antenna 1 is powered at a first end portion and current feed point 1002A-1 of Antenna 1, while the first loop section 1002A of Antenna 2 is powered at a first end portion and current feed point 1002A-2 of Antenna 2. Each of the feed points 1002A-1 and 1002A-2 are coupled to Port 1 and Port 2, respectively. Ports 1 and 2 are formed in, but are separated from, the first ground plane 1006A.

The other end portions of Antennas 1 and 2, which are each opposite to the capacitively coupled edge of the second loop section 1002B, are shorted to the first ground plane 1006A. Antennas 1 and 2 further include two radiating elements, each operating at a different frequency, that are formed in each of the loop sections 1002A and 1002B. For generating/receiving the E and H fields of Antenna 1, which are substantially orthogonal to each other, the radiating element of the second loop section 1002B is placed at the substantially 90° (or 270°) electrical length along the loop element 1002B from the feed point 1002A-1. The same configuration is followed in Antenna 2. The gap 1004 may be configured for size reduction purposes as discussed above. FIG. 10B illustrates the bottom view including a second ground plane 1006B and a resonant isolator 1008 formed of first part 1008A and second part 1008B separated by a gap 1010. The two ground planes are coupled with ground vias, not shown in FIGS. 10A and 10B, but indicated with multiple circles as illustrated in some of the other FIGS. above, to keep them at an equal potential. While the antenna arrangement illustrated in FIGS. 10A and 10B are mirror symmetric, no symmetry is essential and different shaped and configured antennas could be used as part of the two-antenna system.

The implementation of a capacitive loaded resonant isolator as illustrated in FIG. 10B may significantly improve isolation between two closely packed antennas that are separated by less than the operating wavelength of the antennas. Furthermore, the present example allows for area re-use within the C2CPL antenna artwork for the purpose of supporting dual band operation with enhanced isolation in both bands. The resonant isolator for each antenna may be connected to the feed point of the antenna near a low local impedance point (i.e., local current maximum). The total length of the capacitive loaded resonant isolator may be such that the current flowing on its structure undergoes a phase change that additively cancels with the current excited on the non-active portions of antenna at the shared connection points 1002B-1 and 1002B-2. The introduction of a capacitive element in the resonant isolator artwork simultaneously allows for increased miniaturization and dual band operation.

Figure 11:
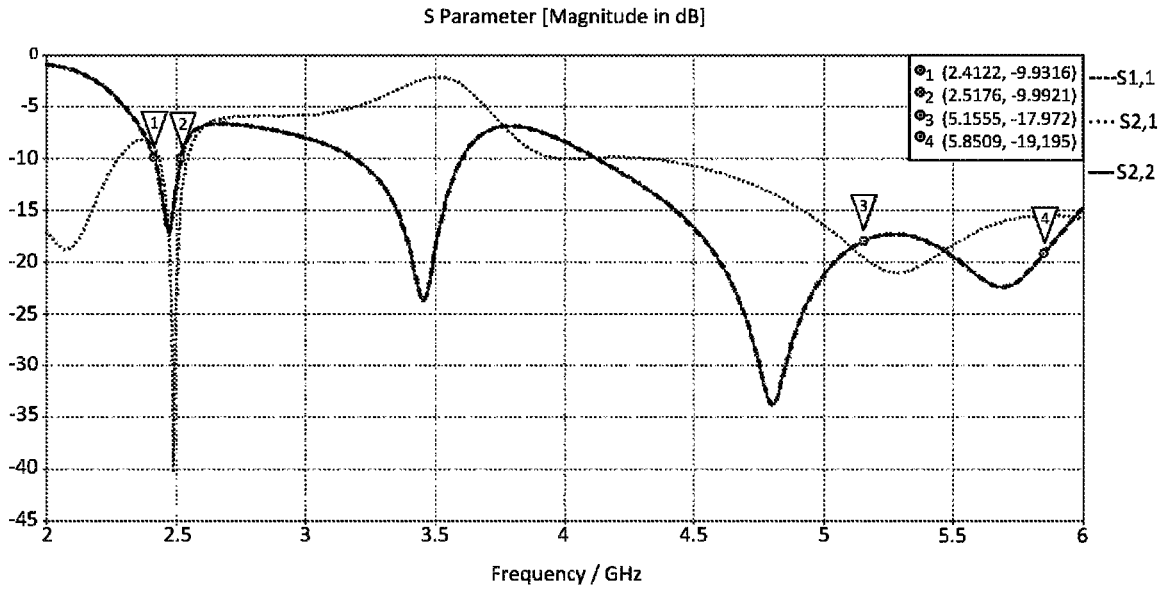
FIG. 11 is a plot illustrating measured S parameters vs. frequency for the example illustrated in FIGS. 10A and 10B at both operating frequencies.

FIG. 11 is a plot illustrating measured S parameters vs. frequency for the example illustrated in FIGS. 10A and 10B at both operating frequencies, where two S parameters are plotted separately. High isolation is achieved near the 2.4 GHz resonance as indicated by the S2,1 parameter value in this plot, and less so at 5.5 GHz as indicated by the S2,2 parameter.

Figure 12A:
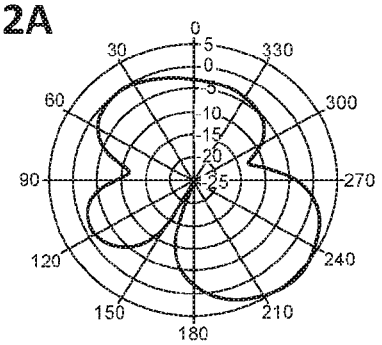
FIGS. 12A, 12B and 12C are plots illustrating measured radiation patterns for the example illustrated in FIGS. 10A and 10B at 2.45 GHz, on the Y-Z plane, the X-Y plane and the X-Z plane, respectively.
Figure 12C:
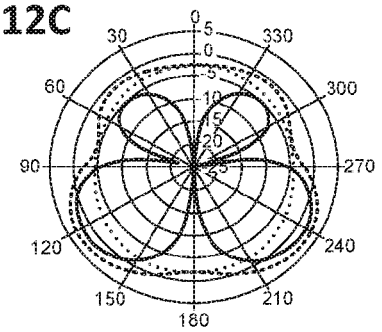
Figure 12B:
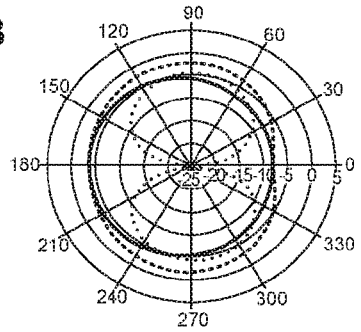
Figure 12B:
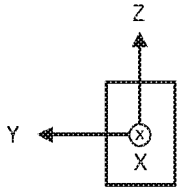
Figure 13A:
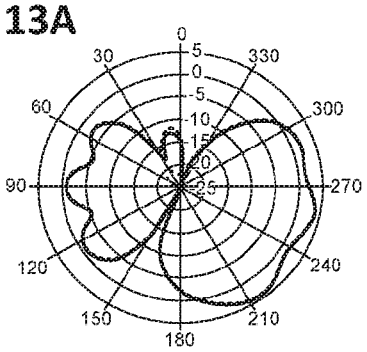
FIGS. 13A, 13B and 13C are plots illustrating measured radiation patterns for the example illustrated in FIGS. 10A and 10B at 5.5 GHz, on the Y-Z plane, the X-Y plane and the X-Z plane, respectively.
Figure 13C:
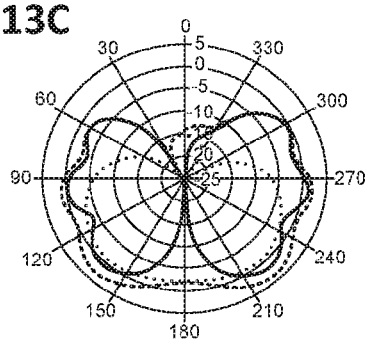
Figure 13B:
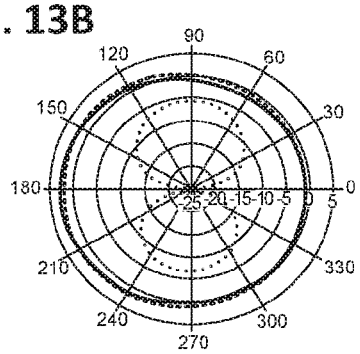
Figure 13B:
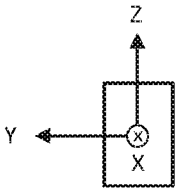

FIGS. 12A, 12B and 12C are plots illustrating measured radiation patterns for the example illustrated in FIGS. 10A and 10B at 2.45 GHz, on the Y-Z plane, the X-Y plane and the X-Z plane, respectively. FIGS. 13A, 13B and 13C are plots illustrating measured radiation patterns for the example illustrated in FIGS. 10A and 10B at 5.5 GHz, on the Y-Z plane, the X-Y plane and the X-Z plane, respectively.

Figure 14:
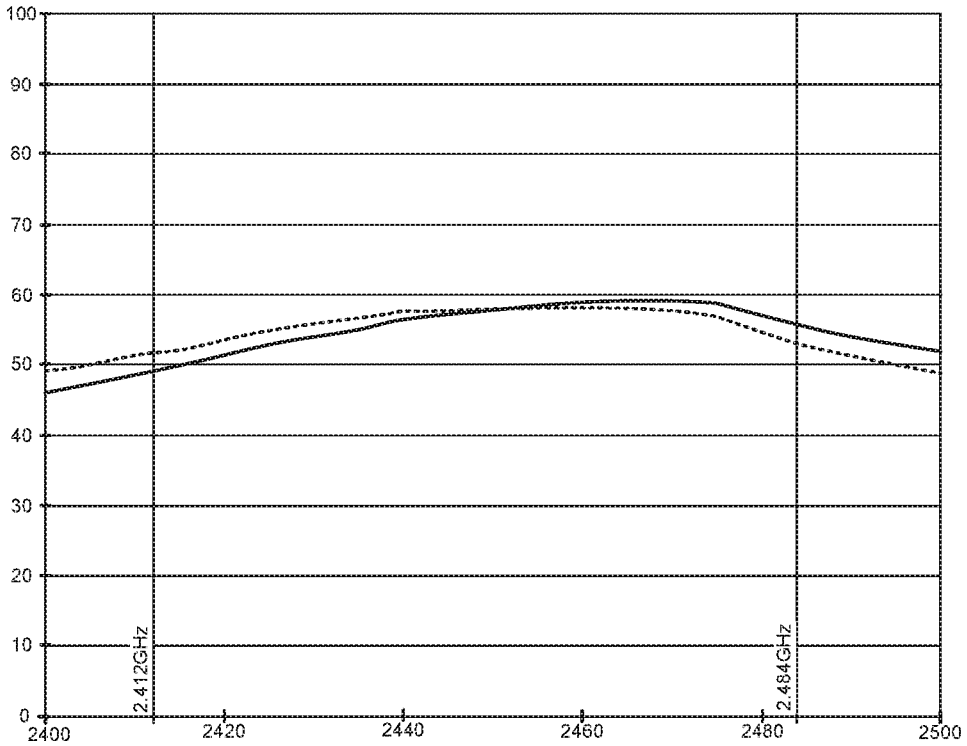
FIG. 14 is a plot illustrating measured efficiency versus frequency for the example illustrated in FIGS. 10A and 10B at 2.45 GHz.
Figure 15:
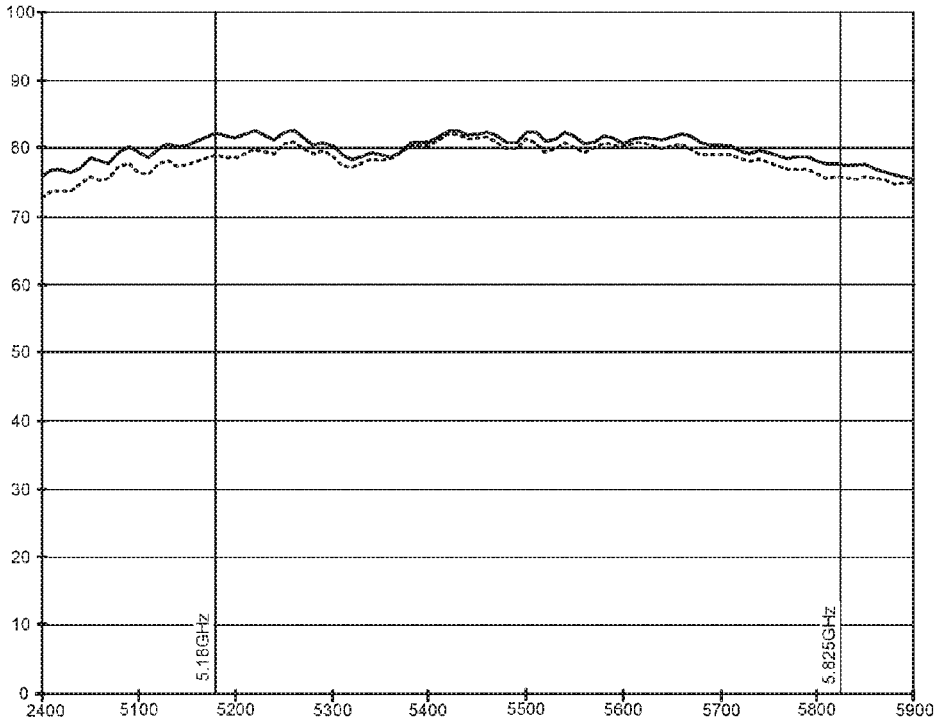
FIG. 15 is a plot illustrating measured efficiency versus frequency for the example illustrated in FIGS. 10A and 10B at 5.5 GHz.

FIG. 14 is a plot illustrating measured efficiency versus frequency for the example illustrated in FIGS. 10A and 10B at 2.45 GHz, and FIG. 15 is a plot illustrating measured efficiency versus frequency for the example illustrated in FIGS. 10A and 10B at 5.5 GHz. In FIG. 14, the near 60% efficiency versus frequency is achieved in the proximity of the 2.45 GHz resonance, in spite of the small device size afforded by the use of C2CPL antennas, while in FIG. 15, the efficiency at 5.5 GHz is near 80%.

In an embodiment, an antenna system comprises a first layer including at least a pair of antennas having a first antenna and a second antenna, the first layer further including a first ground plane; and a second layer including a resonant isolator and a second ground plane, the resonant isolator having a first end portion and a second end portion and being placed on or within the second layer isolated from the second ground plane, the resonant isolator being configured to isolate the first antenna from the second antenna at a resonance when the first antenna is connected to the first end portion by a first via and the second antenna is connected to the second end portion by a second via, the first via and the second via being vertical to the first layer and the second layer; and wherein each of the first antenna and the second antenna include: a first element that is coupled to a current feed point at a first end point and is shorted to the first ground plane at a second end point, the first element emitting a magnetic field; and a second element that is coupled to the first element at an electrical length of substantially 90 degrees or an odd multiple of substantially 90 degrees from the feed point, the second element generating an electrical field substantially orthogonal to the magnetic field.

In the embodiment, wherein the first element comprises a first section, a second section and a gap formed between the first section and the second section, and wherein the first section and the second section are capacitively coupled through the gap. In the embodiment, wherein the second element comprises a first section, a second section and a gap formed between the first section and the second section, and wherein the first section and the second section are capacitively coupled through the gap.

In the embodiment, wherein the resonant isolator has an electrical length of substantially 90 degrees or an odd multiple of substantially 90 degrees that generates a forward wave and a reflective wave having a phase offset resulting in an open circuit at resonance when the forward and backward waves are combined and thereby providing isolation between the first antenna and the second antenna. In the embodiment, wherein the resonant isolator has an electrical length that provides one of a substantially 90 degree phase delay or an odd multiple of a substantially 90 degree phase delay between the first antenna and the second antenna.

In the embodiment, wherein the first via is coupled to the current feed point of the first antenna where a current value is maximum and the second via is coupled to the current feed point of the second antenna where the current value is maximum.

In the embodiment, wherein the first layer includes N pairs of antennas and the second layer includes N resonant isolators, wherein one resonant isolator among the N resonant isolators corresponds to each pair of antennas among the N pairs of antennas.

In the embodiment, wherein the antenna system is a multi-band antenna system and the resonant isolator is configured to isolate the first antenna from the second antenna at each resonance of the multi-band antenna system.

In the embodiment, wherein the resonant isolator includes a conductive line coupling the first end portion to the second end portion. In the embodiment, wherein the resonant isolator includes a gap formed between the first end portion and the second end portion, and wherein the first end portion and the second end portion are capacitively coupled through the gap.

In an embodiment, an antenna system comprises a first pair of antennas including a first antenna and a second antenna; a ground plane; and a resonant isolator having a first end portion coupled to the first antenna and a second end portion coupled to the second antenna, the resonant isolator being configured to isolate the first antenna from the second antenna at resonance when the first antenna is connected to the first end portion and the second antenna is connected to the second end portion, wherein each of the first antenna and the second antenna comprises: a first element that is coupled to a current feed point at a first end point and is shorted to the ground plane at a second end point, the first element emitting a magnetic field; a second element that is coupled to the first element at an electrical length of substantially 90° or an odd multiple of substantially 90 degrees from the feed point, the second element generating an electrical field substantially orthogonal to the magnetic field.

In the embodiment, wherein the first element comprises a first section, a second section and a gap formed between the first section and the second section, and wherein the first section and the second section are capacitively coupled through the gap. In the embodiment, wherein the second element comprises a first section, a second section and a gap formed between the first section and the second section, and wherein the first section and the second section are capacitively coupled through the gap.

In the embodiment, wherein the resonant isolator has an electrical length of substantially 90 degrees or an odd multiple of substantially 90 degrees that generates a forward wave and a reflective wave having a phase offset resulting in an open circuit at resonance when the forward and backward waves are combined and thereby providing isolation between the first antenna and the second antenna. In the embodiment, wherein the resonant isolator has an electrical length that provides one of a substantially 90 degree phase delay or an odd multiple of a substantially 90 degree phase delay between the first antenna and the second antenna.

In the embodiment, wherein the first end portion is coupled to the first antenna at the current feed point of the first antenna where a current value is maximum and the second end portion is coupled to the current feed point of the second antenna where the current value is maximum.

In the embodiment, wherein the resonant isolator includes a conductive line coupling the first end portion to the second end portion. In the embodiment, wherein the resonant isolator includes a gap formed between the first end portion and the second end portion, and wherein the first end portion and the second end portion are capacitively coupled through the gap.

In the embodiment, wherein the first element is a loop element and the second element is a radiating monopole element.

In the embodiment, wherein the radiating element operates at a first frequency, and wherein first element further includes a second radiating element operating at a second frequency substantially different from the first frequency.

In the embodiment, further comprising N pairs of antennas and N resonant isolators, wherein one resonant isolator among the N resonant isolators corresponds to each pair of antennas among the N pairs of antennas.

In the embodiment, wherein the antenna system is a multi-band antenna system and the resonant isolator is configured to isolate the first antenna from the second antenna at each resonance of the multi-band antenna system.

While this document contains many specifics, these should not be construed as limitations on the scope of an invention or of what may be claimed, but rather as descriptions of features specific to particular embodiments of the invention. Certain features that are described in this document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be exercised from the combination, and the claimed combination may be directed to a subcombination or a variation of a subcombination.

What is claimed:

1. An antenna system, comprising:

a first layer including at least a pair of antennas having a first antenna and a second antenna, the first layer further including a first ground plane; and a second layer including a resonant isolator and a second ground plane, the resonant isolator being a conductive element that is placed on or within the second layer separate from the second ground plane, the resonant isolator having a first end portion and a second end portion, the resonant isolator being configured to electromagnetically isolate the first antenna from the second antenna at a resonance, the first end portion being coupled to the first antenna by a first via and the second end portion being coupled to the second antenna by a second via, the first via and the second via being formed vertical to the first layer and the second layer and separated from the first and second ground planes; and wherein each of the first antenna and the second antenna include:

a first element that is coupled to a current feed point at a first end point and is shorted to the first ground plane at a second end point, the first element emitting a magnetic field; and a second element that is coupled to the first element at an electrical length of substantially 90 degrees or an odd multiple of substantially 90 degrees from the feed point, the second element generating an electrical field substantially orthogonal to the magnetic field.

2. The antenna system of claim 1, wherein the first element comprises a first section, a second section and a gap formed between the first section and the second section, and wherein the first section and the second section are capacitively coupled through the gap.

3. The antenna system of claim 1, wherein the second element comprises a first section, a second section and a gap formed between the first section and the second section, and wherein the first section and the second section are capacitively coupled through the gap.

4. The antenna system of claim 1, wherein the resonant isolator has an electrical length of substantially 90 degrees or an odd multiple of substantially 90 degrees that generates a forward wave and a reflective wave having a phase offset resulting in an open circuit at resonance when the forward and backward waves are combined and thereby providing isolation between the first antenna and the second antenna.

5. The antenna system of claim 1, wherein the resonant isolator has an electrical length that provides one of a substantially 90 degree phase delay or an odd multiple of a substantially 90 degree phase delay between the first antenna and the second antenna.

6. The antenna system of claim 1, wherein the first via is coupled to the current feed point of the first antenna where a current value is maximum and the second via is coupled to the current feed point of the second antenna where the current value is maximum.

7. The antenna system of claim 1, wherein the first layer includes N pairs of antennas and the second layer includes N resonant isolators, wherein one resonant isolator among the N resonant isolators corresponds to each pair of antennas among the N pairs of antennas.

8. The antenna system of claim 1, wherein the antenna system is a multi-band antenna system and the resonant isolator is configured to isolate the first antenna from the second antenna at each resonance of the multi-band antenna system.

9. The antenna system of claim 1, wherein the resonant isolator includes a conductive line coupling the first end portion to the second end portion.

10. The antenna system of claim 1, wherein the resonant isolator includes a gap formed between the first end portion and the second end portion, and wherein the first end portion and the second end portion are capacitively coupled through the gap.

11. An antenna system comprising:

a first pair of antennas including a first antenna and a second antenna;

a ground plane; and a resonant isolator having a first end portion coupled to the first antenna and a second end portion coupled to the second antenna, the resonant isolator being a conductive element placed separately from the ground plane, the resonant isolate being configured to electromagnetically isolate the first antenna from the second antenna at resonance, wherein each of the first antenna and the second antenna comprises:

a first element that is coupled to a current feed point at a first end point and is shorted to the ground plane at a second end point, the first element emitting a magnetic field;

a second element that is coupled to the first element at an electrical length of substantially 90° or an odd multiple of substantially 90 degrees from the feed point, the second element generating an electrical field substantially orthogonal to the magnetic field.

12. The antenna system of claim 11, wherein the first element comprises a first section, a second section and a gap formed between the first section and the second section, and wherein the first section and the second section are capacitively coupled through the gap.

13. The antenna system of claim 11, wherein the second element comprises a first section, a second section and a gap formed between the first section and the second section, and wherein the first section and the second section are capacitively coupled through the gap.

14. The antenna system of claim 11, wherein the resonant isolator has an electrical length of substantially 90 degrees or an odd multiple of substantially 90 degrees that generates a forward wave and a reflective wave having a phase offset resulting in an open circuit at resonance when the forward and backward waves are combined and thereby providing isolation between the first antenna and the second antenna.

15. The antenna system of claim 11, wherein the resonant isolator has an electrical length that provides one of a substantially 90 degree phase delay or an odd multiple of a substantially 90 degree phase delay between the first antenna and the second antenna.

16. The antenna system of claim 11, wherein the first end portion is coupled to the first antenna at the current feed point of the first antenna where a current value is maximum and the second end portion is coupled to the current feed point of the second antenna where the current value is maximum.

17. The antenna system of claim 11, wherein the resonant isolator includes a conductive line coupling the first end portion to the second end portion.

18. The antenna system of claim 11, wherein the resonant isolator includes a gap formed between the first end portion and the second end portion, and wherein the first end portion and the second end portion are capacitively coupled through the gap.

19. The antenna system of claim 11, wherein the first element is a loop element and the second element is a radiating monopole element.

20. The antenna system of claim 19, wherein the radiating element operates at a first frequency, and wherein first element further includes a second radiating element operating at a second frequency substantially different from the first frequency.

21. The antenna system of claim 11, further comprising N pairs of antennas and N resonant isolators, wherein one resonant isolator among the N resonant isolators corresponds to each pair of antennas among the N pairs of antennas.

22. The antenna system of claim 11, wherein the antenna system is a multi-band antenna system and the resonant isolator is configured to isolate the first antenna from the second antenna at each resonance of the multi-band antenna system.

* * * * *